US007734221B2

(12) United States Patent
Oshima et al.

(10) Patent No.: US 7,734,221 B2
(45) Date of Patent: Jun. 8, 2010

(54) CONDUCTIVE MEMBER, PROCESS CARTRIDGE USING CONDUCTIVE MEMBER AND IMAGE FORMATION APPARATUS USING PROCESS CARTRIDGE

(75) Inventors: Tadayuki Oshima, Atsugi (JP); Hiroki Furubayashi, Atsugi (JP); Taisuke Tokuwaki, Sagamihara (JP); Tadaaki Hattori, Hadano (JP); Toshio Kojima, Isehara (JP); Makoto Nakamura, Ebina (JP); Yutaka Narita, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 674 days.

(21) Appl. No.: 11/620,365

(22) Filed: Jan. 5, 2007

(65) Prior Publication Data

US 2007/0166076 A1 Jul. 19, 2007

(30) Foreign Application Priority Data

Jan. 19, 2006 (JP) ..... 2006-011276

(51) Int. Cl.
*G03G 15/02* (2006.01)

(52) U.S. Cl. ..... 399/168

(58) Field of Classification Search ..... 399/168
See application file for complete search history.

(56) References Cited

U.S. PATENT DOCUMENTS

| | | | | |
|---|---|---|---|---|
| 2005/0100365 | A1 | 5/2005 | Narita et al. | |
| 2005/0175374 | A1 * | 8/2005 | Kosuge | 399/168 |
| 2006/0188293 | A1 | 8/2006 | Narita et al. | |
| 2006/0270541 | A1 | 11/2006 | Narita et al. | |

FOREIGN PATENT DOCUMENTS

| | | | |
|---|---|---|---|
| JP | 3-240076 | | 10/1991 |
| JP | 4-358175 | | 12/1992 |
| JP | 5-107871 | | 4/1993 |
| JP | 7-121009 | | 5/1995 |
| JP | 2001082451 | A * | 3/2001 |
| JP | 2002-132019 | | 5/2002 |
| JP | 2005-17767 | | 1/2005 |
| JP | 2005-91818 | | 4/2005 |
| JP | 2006-113444 | | 4/2006 |

OTHER PUBLICATIONS

U.S. Appl. No. 11/837,751, filed Aug. 13, 2007, Nakamura, et al.
U.S. Appl. No. 11/836,950, filed Aug. 10, 2007, Tokuwaki, et al.
U.S. Appl. No. 11/854,947, filed Sep. 13, 2007, Oshima, et al.

* cited by examiner

*Primary Examiner*—David M Gray
*Assistant Examiner*—Erika Villaluna
(74) *Attorney, Agent, or Firm*—Oblon, Spivak, McClelland, Maier & Neustadt, L.L.P.

(57) ABSTRACT

The present invention provides a conductive member 10 with a superior durability by controlling an electric resistance value of an electric resistance adjusting layer 2 within a semi conductive range, preventing an ion conductive material from bleeding out of the electric resistance adjusting layer 2 to avoid improper charging and avoiding strength decreasing of a weld portion of the electric resistance adjusting layer and an electric resistance value fluctuation. The electric resistance adjusting layer 2 is made from a resin composition prepared by melting and kneading a thermoplastic resin, a high molecular ion conductive material containing an alkali metal salt and a graft copolymer which has an affinity for both the thermoplastic resin and the high molecular ion conductive material.

20 Claims, 2 Drawing Sheets

CONDUCTIVE MEMBER, PROCESS CARTRIDGE USING CONDUCTIVE MEMBER AND IMAGE FORMATION APPARATUS USING PROCESS CARTRIDGE

CROSS-REFERENCE TO THE RELATED APPLICATION

The present application claims the priority benefit of Japanese Patent Application No. 2006-011276 filed on Jan. 19, 2006, the contents of which are incorporated herein by reference in its entirety.

BACKGROUND OF THE INVENTION

1. Field of the Invention

The present invention relates to a conductive member, which is used in an image formation apparatus such as an electrophotographic copier, a laser printer, a facsimile and the like, and a process cartridge using the conductive member and an image formation apparatus using the process cartridge.

2. Description of the Prior Art

In a conventional electrophotographic image formation apparatus such as an electrophotographic copier, a laser printer, a facsimile and the like, a charge roller is generally used as a charge member for performing a charge processing to an image carrier or a photoreceptor. An explanatory view of the conventional electrophotographic image formation apparatus having the charge roller is illustrated in FIG. 4.

In FIG. 4, a numeral 120 represents the conventional electrophotographic image formation apparatus including an image carrier 101, a charge roller 102, a laser exposing device 103, a development roller 104, a power pack 105, a transfer roller 106, a cleaning device 108 and a surface potentiometer 109.

An electrostatic latent image is formed on a surface of the image carrier 101. The charge roller 102 contacts the image carrier 101 and performs the charge processing to the image carrier 101. The development roller 104 is used to have toners attracted to the electrostatic latent image on the surface of the image carrier 101 to form a toner image thereon. The power pack 105 is used to apply a DC voltage to the charge roller 102. The transfer roller 106 transfers the toner image on the surface of the image carrier 101 to a recording paper 107. The cleaning device 108 is for cleaning the image carrier 101 after the toner image is transferred. The surface potentiometer 109 is for determining a surface potential of the image carrier 101.

Moreover, the conventional electrophotographic image formation apparatus 120 is such an apparatus that a process cartridge thereof is detachable. In other words, the process cartridge 110 including in block four processing devices of the image carrier 101, the charge roller 102, the development roller 104 and the cleaning device 108 may be attached to the image formation apparatus or detached from it at will. It is also preferable for the process cartridge 110 to include at least the image carrier 101 and the charge roller 102. When the process cartridge 110 is attached to a predefined place of the image formation apparatus, it is connected to a driving system and an electric system on a main body of the image formation apparatus. Moreover, other functional units generally used in an electrographic processor are omitted in FIG. 3 since they are not necessary in the present invention.

A general image formation process via charging of the conventional electrophotographic image formation apparatus 120 will be explained as follows.

When a DC voltage is applied from the power pack 105 to the charge roller 102 contacting the image carrier 101, thus the surface of the image carrier 101 is charged uniformly with a high potential. It is known that such kind of charging mechanism which charges the surface of the image carrier 101 through the charge roller 102 follows the Paschen rule within a small space between the charge roller 102 and the image carrier 101. After the surface of the image carrier 101 is charged, an image light is projected by the exposing device 103 onto the surface of the image carrier 101, a potential of a portion wherever projected decreases.

Since the image light corresponds to the light amount distribution of the image, when the surface of the image carrier 101 is projected by the image light, a potential distribution corresponding to the image, in other words, an electrostatic latent image is formed thereon. When the portion of the surface of the image carrier 101 formed with the electrostatic latent image passes the development roller 104, the toner is attracted to the electrostatic latent image according to the potential levels and as a result there forms a visible toner image from the latent image.

The recording paper 107 is transported by a resist roller (not illustrated) at a predefined timing to the portion where the visible toner image is formed to overlap with the toner image. The recording paper 107 is peeled off from the image carrier 101 after the toner image is transferred by the transfer roller 106 onto the recording paper 107. The peeled recording paper 107 is transported through a transportation path to a fuser unit (not illustrated) to be fused via heating and finally expelled out from the apparatus 120. After that, any remaining toner on the surface of the image carrier 101 is removed by the cleaning device 108, and any remaining charge thereon is discharged by a quenching lamp (not illustrated). Thus, the apparatus 120 is ready for a next image formation process.

In general, a charge method using a charge roller is to charge the image carrier by contacting the charge roller with the image carrier. For such charge method by contact, there are such problems as listed in the following:

(1) A material constituting the charge roller exudes out from the charge roller and thus leaves a trail when it contacts and moves on a surface of a member to be charged;

(2) When an alternating currency is applied to the charge roller, the charge roller contacting the member to be charged vibrates, causing a charging noise;

(3) Adhesion of toners from the image carrier to the charge roller (In particular such adhesion occurs more easily when there is an exudation as mentioned above) lowers charging performance of the charge roller;

(4) A material constituting the charge roller adheres to the image carrier; and (5) The charge roller deforms permanently when the image carrier has been idle for a long time.

To solve such problems, an adjacent charge method by making the charge roller close to the image carrier has been disclosed in Japan Patents Laid-Open Nos. H3-240076, H4-358175 and H5-107871. Such adjacent charge method performs charging to the image carrier by applying a voltage to the charge roller which is disposed oppositely to the image carrier at a closet distance from 50 μm to 100 μm. Since the charge roller and the image carrier are not contacted in the adjacent charge method, it will not have such problems as those in the conventional charge method by contact and will not have the problem such as that the charging performance of the charge roller is lowered by the adhesion of toners to the charge roller.

Characteristic properties required for the charge roller used in the adjacent charge method are different to those required for the charge roller used in the charge method by contact.

Generally the charge roller used in the charge method by contact is formed by coating an elastic member such as a vulcanized rubber or the like around a cored bar. In order to charge the image carrier uniformly using such charge roller, it is mandatory that the charge roller contact uniformly with the image carrier.

However, in a case where the charge roller formed from an elastic member such as a vulcanized rubber or the like is used in the adjacent charge method, there are such problems as listed in the following:

(1) It is necessary to dispose a gap preserving member such as a spacer or the like at both ends of the charge roller corresponding to none image areas in order to provide a gap between the charge roller and the image carrier. While it is difficult for the gap to be kept uniformly because of the deformation of the charge roller formed from the elastic member, and this causes potential variations and image irregularities resulted from the potential variations.

(2) It is easy for the vulcanized rubber constituting the elastic member to have strain and deformation over time, and as a result the gap will vary over time.

To solve such problems it has been proposed to use a non-elastic member, a thermoplastic resin which makes it possible to uniform the gap between the image carrier and the charge roller. It is known that a charging mechanism which charges the surface of the image carrier (photoreceptor drum) through the charge roller follows the Paschen rule within a small space between the charge roller and the image carrier. In order to keep the image carrier at a predefined charge potential level, it is necessary to control the electric resistance value of the thermoplastic resin within a semi conductive range of about $10^6$ to $10^9$ Ωcm.

Among methods to control the electric resistance value, there is one to disperse conductive pigments such as carbon blacks or the like in the thermoplastic resin. However, such method will cause bigger irregular variations on the electric resistance value, resulting in a partially unfavorable charging which leads to a problem of improper image formation.

There is also another method to control the electric resistance value of an electric resistance adjusting layer is to add an ion conductive material, in other words a electrolyte salt such as a lithium salt or the like to the electric resistance adjusting layer. Such ion conductive material may be dispersed at a molecular level in a matrix resin, therefore the irregular variations on the electric resistance value is smaller than that dispersed with the conductive pigments, resulting in a smaller partially unfavorable charging which will not affect the image quality. However, the electrolyte salt such as the lithium salt or the like has a low molecular weight and thus has a character to bleed out to the surface of the matrix resin easily. When the electrolyte salt bleeds out to the surface of the charge roller, it will attract toners, leading to a problem of improper image formation.

In order to avoid the bleeding out of the electrolyte salt, it has been proposed to use a high molecular ion conductive material which is dispersed and fixed in the matrix resin. In such case, it is difficult for the high molecular ion conductive material to bleed out to the surface of the matrix resin. Japan Patent Laid-Open No. H7-121009 discloses a charge roller which includes an electric resistance adjusting layer made from the matrix resin by dispersing and fixing therein the high molecular ion conductive material having a quaternary ammonium group and has fewer bleeding out over time.

However it is impossible to control the electric resistance value within the semi conductive range only by using the high molecular ion conductive material, other methods are necessarily needed to regulate the electric resistance value.

In such dispersion system of the high molecular ion conductive material, in a case that the high molecular ion conductive material is an island ingredient of a sea-island dispersion, the isolating matrix resin retards a currency therethrough, thus problems such as the electric resistance value for the electric resistance adjusting layer decreases below the semi conductive range or the electric resistance value depends much heavily on a power voltage arise. Moreover, when a dispersed particle of the sea-island dispersion becomes large in diameter, there is such problem that the electric resistance value varies as strength of a weld portion formed in molding decreases.

Furthermore, when resins with low mechanical strength or resin with bad compatibility are used as the matrix resin, cracks may occur to the weld portion of the electric resistance adjusting layer according to an electric or mechanical stress during using, or to a volume variation caused by time or circumstance. The electric resistance variation of the weld portion may cause a problem of partially improper images.

SUMMERY OF THE INVENTION

An object of the present invention is to provide a conductive member with a superior durability by controlling an electric resistance value of an electric resistance adjusting layer within a semi conductive range, preventing an ion conductive material from bleeding out of the electric resistance adjusting layer to avoid improper charging and avoiding strength decreasing of a weld portion of the electric resistance adjusting layer and an electric resistance value fluctuation.

To attain the above mentioned object, the present invention provides a conductive member including a conductive supporter; a electric resistance adjusting layer formed on the conductive supporter; and gap preserving members which are of a different material from that of the electric resistance adjusting layer and are disposed respectively at both ends of the electric resistance adjusting layer for contacting an image carrier so as to preserve a predefined gap between the electric resistance adjusting layer and the image carrier.

The electric resistance adjusting layer is made from a resin composition prepared by melting and kneading a thermoplastic resin, a high molecular ion conductive material containing an alkali metal salt; and a graft copolymer which has an affinity for both the thermoplastic resin and the high molecular ion conductive material.

Preferably, the alkali metal salt is a lithium salt.

Preferably, the high molecular ion conductive material is made from a compound at least having an ether group.

Advantageously, the compound at least having an ether group is a compound containing a polyether ester amide, or a polyether-polyolefin block polymer.

Preferably, the graft copolymer includes a polycarbonate in a main chain and an acrylonitrile-styrene-glycidyl methacrylate terpolymer in a side chain.

Preferably, the gap preserving member is adhesively fixed on at least one sort of the conductive supporter and the electric resistance adjusting layer.

Advantageously, the gap preserving member is adhesively fixed on at least one sort of the conductive supporter and the electric resistance adjusting layer via a primer applied to the gap preserving member.

Preferably, the electric resistance adjusting layer includes a protection layer which prevents a toner from attaching to an outer surface of the electric resistance adjusting layer.

Preferably, the electric resistance adjusting layer and the gap preserving member are provided with a cylinder shape.

Preferably, the conductive member is a charge member.

Preferably, the charge member disposed close to a member to be charged is included in a process cartridge.

Preferably, the process cartridge is included in an image formation apparatus.

DETAILED DESCRIPTION OF THE INVENTION

Hereinafter, embodiments of the present invention will be described with reference to the drawings.

Figure 1:
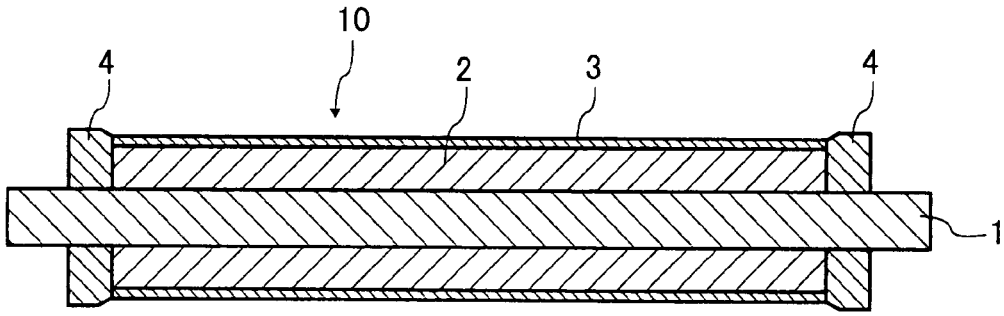
FIG. 1 is a cross-sectional view illustrating an embodiment of a conductive member (charge roller) according to the present invention.

In FIG. 1, the numeral 10 represents a conductive member (charge roller) which includes a conductive supporter 1, a electric resistance adjusting layer 2 formed on the conductive supporter 1 and gap preserving members 4 and 4 which are of a different material from that of the electric resistance adjusting layer 2 and are disposed respectively at both ends of the electric resistance adjusting layer 2 for contacting a image carrier 5 so as to preserve a predefined gap G (FIG. 2) between the electric resistance adjusting layer 2 and the image carrier 5.

The electric resistance adjusting layer 2 is made from a resin composition prepared by melting and kneading a thermoplastic resin, a high molecular ion conductive material containing an alkali metal salt and a graft copolymer which has an affinity for both the thermoplastic resin and the high molecular ion conductive material.

It is possible to control an electric value of the layer 2 within a semi conductive range and to prevent an improper charging associated with a bleeding out by comprising a high molecular ion conductive material in the electric resistance adjusting layer 2. Moreover, it is possible to prevent the strength of a weld portion from decreasing and to prevent the electric resistance value from varying by comprising in the electric resistance adjusting layer 2 a graft copolymer with an affinity for both thermoplastic resin and high molecular ion conductive material.

Since the electric resistance adjusting 2 of the present invention is made from a resin composition prepared by melting and kneading a thermoplastic resin, a high molecular ion conductive material containing an alkali metal salt and a graft copolymer which has an affinity for both the thermoplastic resin and the high molecular ion conductive material, therefore it is possible for the present invention to provide the conductive member 10 with a superior durability by controlling the electric resistance value of the electric resistance adjusting layer 2 within the semi conductive range, preventing the ion conductive material from bleeding out of the electric resistance adjusting layer 2 to avoid improper charging and avoiding strength decreasing of the weld portion of the electric resistance adjusting layer and variations of the electric resistance value.

The resin composition contains no conductive pigments, such as carbon blacks or the like, which will cause abnormal charging according a fluctuation on the electric resistance value and affect image quality. The intrinsic volume resistance value for the electric resistance adjusting layer 2 is preferably in a range of $10^6$ to $10^9$ Ωcm. If the intrinsic volume resistance value is larger than $10^9$ Ωcm, charging ability and transferring ability are not enough. While if the intrinsic volume resistance value is smaller than $10^6$ Ωcm, power voltage concentrated to the image carrier may cause a leak.

The thermoplastic resin which is comprised in the electric resistance adjusting layer 2 is preferably an universal resin with perfect moldability, such as polyethylene (PE), polypropylene (PP), polymethyl methacrylate (PMMA), polystyrene (PS) and a copolymer of them. It is also preferable for it to be a resin other than the mentioned without departing from the object of the present invention.

The alkali metal salt contained in the high molecular ion conductive material which is comprised in the electric resistance adjusting layer 2 is preferably an alkali metal salt with a negative ion having a fluoro group and a sulfonyl group. In such alkali metal salt with a negative ion, charges are delocalized according to a strong attraction effect by the fluoro group (—F) and the sulfonyl group (—$SO_2$—), thus the negative ion has a high dissociation degree in the stable polymer composition, therefore a high ion conductivity is realized.

Such alkali metal salt with a negative ion is preferably $(CF_3SO_2)_2NLi$, $(CF_3SO_2)_2NK$ or $CF_3SO_3Li$. Among them, Lithium salts with a high conductivity are particularly preferred as they may make an electric resistance value drop easily. Thus when a lithium salt is used as the alkali metal salt, it is easy to set the electric resistance value of the electric resistance adjusting layer 2 in the semi conductive range. The alkali metal salt is preferably composed in the high molecular ion conductive material at 0.01 wt % to 20 wt %.

Such high molecular ion conductive material containing the lithium salt is commercially available from Suncall and/or Sanko Chemical Co., Ltd., Japan.

Advantageously, the high molecular ion conductive material contains in the molecule at least an ether group. The alkali metal salt is further stabilized by the oxygen atom in the ether group, thus it is possible to obtain a much lower electric resistance value. Specifically, at least a polyether ester amide and a polyether-polyolefin block polymer may be used as the high molecular ion conductive material.

The high molecular ion conductive material having the mentioned chemical structure may be uniformly dispersed and fixed at a molecular level in the matrix polymer, thus the electric resistance fluctuation and bleeding out of the electric resistance adjusting layer 2 may be prevented. Therefore, it is possible to make available the electric resistance adjusting layer 2 have an electric resistance value depending slightly on circumstances and a superior electric characteristic in any circumstance.

Advantageously, the graft copolymer which makes up the electric resistance adjusting layer 2 and has an affinity for both the thermoplastic resin and the high molecular ion conductive material includes a polycarbonate resin in a main chain and an acrylonitrile-styrene-glycidyl methacrylate copolymer in a side chain.

Owing to its molecular structure having a chain with a polar group and a dioxy-group, the polycarbonate resin in the main chain has a very strong intermolecular attractive force. As a result, the graft copolymer is superior in dynamic strength and creep characteristic, in particular remarkably superior in impact tenacity compared with other plastics. Moreover, the graft copolymer is relatively less water-absorptive and thus its volume varies less according to the water absorption. According to these characteristics, when such graft copolymer is used, it is difficult to have a crack occurred thereon according to mechanical stress, electric stress, or volume fluctuation over time or by circumstance.

The acrylonitrile-styrene-glycidyl methacrylate copolymer in the side chain is made from acrylonitrile, styrene and glycidyl methacrylate. When the glycidyl methacrylate is heated to melt and kneaded to form the resin composition, its epoxy group reacts with the ester group or amino group in the high molecular ion conductive material to form a strong chemical bonding between the glycidyl methacrylate and the high molecular ion conductive material. The acrylonitrile and styrene have a perfect compatibility with the thermoplastic resin, thus the graft copolymer acts as a compatible reagent between the plastic resin and the high molecular ion conductive material which in origin have a low affinity and as a result of this, the thermoplastic resin and the high molecular ion conductive material may be dispersed uniformly and densely.

Therefore, it is possible to inhibit the electric resistance value fluctuation on the weld portion according to improper dispersion of the thermoplastic resin and the high molecular ion conductive material, and cracks occurred on the weld portion of the electric resistance adjusting layer 2 according to electric or mechanic stress during usage, and the volume fluctuation over time or by circumstance. Accordingly, together with the advantageous effects of the main chain, it is possible to obtain a kneading-type resin composition with superior strength.

According, the graft copolymer may act as a compatible reagent and therefore it is possible to inhibit the electric resistance value fluctuation on the weld portion according to improper dispersion of the thermoplastic resin and the high molecular ion conductive material, and cracks occurred on the weld portion of the electric resistance adjusting layer 2 according to electric or mechanic stress during usage, and the volume fluctuation over time or by circumstance when such graft copolymer is used.

Appropriate ingredient contents for the resin composition according to the present invention are mandatory to set the electric resistance value of the electric resistance adjusting layer to a desired value, it is preferable for the thermoplastic resin to be at 30 wt % to 50 wt % and the high molecular ion conductive material to be at 50 wt % to 70 wt %. It is preferable for the graft copolymer to be at 1 wt % to 15 wt % with respect to a total amount of the thermoplastic resin and the high molecular ion conductive material in order to improve the compatibility of the thermoplastic resin and the high molecular ion conductive material and to obtain a superior processing stability.

There is no limitation to the preparation method for preparing the resin composition of the present invention. The resin composition may be easily prepared by melting and kneading a mixture of all ingredients using a biaxial kneading machine, a kneader or the like. It is easy to form the electric resistance adjusting layer 2 on the conductive supporter 1 by coating the resin composition on the conductive supporter 1 through a method such as extrusion molding or injection molding.

In the present invention, the gap preserving members 4 and 4 with an arbitrary shape are inserted to two ends of the electric resistance adjusting layer 2. It is preferable for the gap preserving members 4 and 4 to be adhesively fixed on at least one sort of the conductive supporter 1 and the electric resistance adjusting layer 2 to prevent it from rotating or detaching and to maintain stable the gap G between the image carrier 5 and the conductive member 10 (Refer to FIG. 5) in a preparation process or through a long-term usage.

A primer applied to the gap preserving members 4 and 4 is preferred to adhesively fix more firmly the gap preserving members 4 and 4 on at least one sort of the conductive supporter 1 and the electric resistance adjusting layer 2 so as to prevent toner particles from entering or sticking. Accordingly, it is possible to maintain the gap G between the image carrier 5 and the conductive member 10 stable through a long-term usage.

An adhesive used to adhesively fix the gap preserving members 4 and 4 may be any one of adhesives having a polarity dependent property, an epoxy adhesive is preferable because of its high adhesive ability. Usage of these adhesives in combination with the primer may obtain strong adhesive effect even in such material as polyolefin which is remarkably difficult to be glued. As a result, it is possible to maintain the gap G between the image carrier 5 and the conductive member 10 stable through a long-term usage.

Though there is no limitation to a material which forms the gap preserving members 4 and 4 if it is an insulating material, from a standpoint that it should be soft enough as not to damage the image carrier 5 and it should be easily molded in a molding process, it is preferable for the material to be a thermoplastic resin such as a polyethylene with a high density. It is more preferable that the gap preserving members 4 and 4 are made from an insulating material with an intrinsic volume resistance value not smaller than $10^{13}$ Ωcm to avoid a short out with respect to the image carrier 5.

Figure 2:
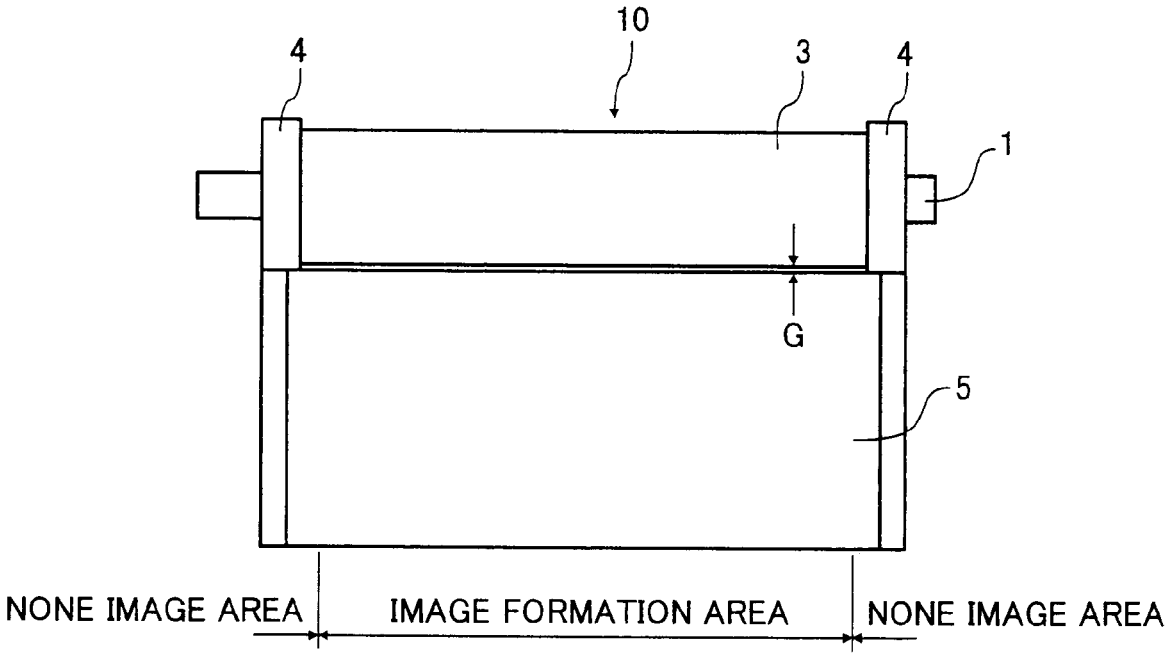
FIG. 2 is a pattern diagram illustrating a state when the conductive member (charge roller) is disposed on an image carrier.

As illustrated in FIG. 2, the conductive member 10 of the present invention is disposed with an arbitrary force to contact the image carrier 5. The gap preserving members 4 and 4 are formed at none image areas outside an image formation area. In such state, it is possible to charge the image carrier 5 by applying a power voltage to the conductive member 10. It is also possible to perform the charging to the image carrier 5 even if the conductive member 10 is used as a transfer member. It is necessary to keep the gap G between the conductive member 10 and the image carrier 5 at a predefined value, preferably not larger than 100 μm. If the value for the gap G is large than 100 μm, it is easy for the conductive member 10 to have problems such as electric deterioration and abnormal discharge, as a result it is mandatory to apply a higher power voltage to the conductive member 10.

In order to form the gap G with a predefined value between outer peripheral surfaces of the respective image carrier 5 and conductive member 10 when the gap preserving members 4 and 4 contact the image carrier 5, there is provided an elevation difference for an outer surface of the gap preserving members 4 and 4 with respective to an outer peripheral surface of the electric resistance adjusting layer 2. Since the gap preserving members 4 and 4 are disposed at the electric resistance adjusting layer 2, when the electric resistance adjusting layer 2 varies in dimension according to a circumstance changing, it is possible for the gap preserving members 4 and 4 to follow the dimension variation so as to inhibit variations to the gap G and keep it constant.

The elevation difference is integrally formed through cutting, grinding or the like on the outer peripheral surface of the gap preserving members 4 and 4 disposed on the conductive member 10 and the outer peripheral surface of the electric resistance adjusting layer 2 disposed on the conductive supporter 1, thus it is possible to minimize variations (vibrations) to the gap G and improve its precision.

Preferably, the electric resistance adjusting layer 2 according to the present invention includes a protecting layer 3 which prevents toners from adhering to its outer surface, therefore it is possible to prevent the gap G and the electric characteristics of the electric resistance adjusting layer 2 from changing caused by adhesion of toners and toner additives over time to the surface of the conductive member 10.

An intrinsic volume resistance value of the protection layer 3 according to the present invention is set larger to that of the electric resistance adjusting layer 2 to prevent a power voltage concentration or abnormal discharge to a defect portion of the image carrier 5. Too high intrinsic volume resistance value of the protection layer 3 may cause insufficient charging or transferring ability to the image carrier 5, thus it is preferable to set the electric resistance value difference between the protection layer 3 and the electric resistance adjusting layer 2 not larger than $10^3$ Ωcm.

A material for the protection layer 3 is preferably a resin such as a fluorine resin, a silicon resin, a polyamide resin or a polyester resin. These resins are preferred from the standpoint of preventing toner adhesion because they have a superior non-adhesive property. Since these resins are electrically insulating, it is possible for them to adjust the electric resistance value of the protection layer 3 through dispersing various conductive materials with respect to the resins.

To form the protection layer 3 on the electric resistance adjusting layer 2, the above mentioned resin material for the protection layer 3 is dissolved in an organic solvent to prepare a coating material which is then applied by spraying, dipping, roll-coating or the like to the electric resistance adjusting layer 2 preferably at a thickness of 10 μm to 30 μm.

The resin material for the protection layer 3 may be used as a one-ingredient fluid or two-ingredient fluid. If a two-element fluid is used in combination with a curing agent, it is possible to improve its durability and non-adhesive property. It is common to cross link or harden a resin by heating the resin coating when a two-element fluid is used. However it is impossible to perform heating at a high temperature if the electric resistance adjusting layer 2 is made from a thermoplastic resin.

A two-ingredient fluid containing a main agent which has a hydroxyl group in molecule and an isocyanate resin which undergoes a cross-linking reaction with the hydroxyl group is preferred. The isocyanate resin can undergo a cross-linking or curing reaction at a relatively low temperature at 100° C. or lower. It is found by inventors of the present invention that a silicon resin, particularly an acryl silicon resin having an acryl backbone in molecule has a high non-adhesive property and is a perfect resin to prevent toner adhesion.

Electric characteristic (electric resistance value) is important for the conductive member 10, thus it is necessary to provide the protection layer 3 a conductive property by dispersing a conductive material in a resin material which makes up the protection layer 3.

There is no limitation to the conductive material in particular. A conductive carbon such as KETJEN Black EC or Acetylene Black, a carbon for producing rubber such as SAF, ISAF, HAF, FEE, GPF, SRF, FT, or MT, an acidified color carbon, a thermal decomposed carbon, a metal and a metal oxide such as indium-doped tin oxide (ITO), tin oxide, titanium oxide, zinc oxide, copper, silver or germanium, a conductive polymer such as polyaniline, polypyrrole or polyacetylene may be raised as an example of the conductive material.

An ion conductive material which is also called as a conductive additive may be an inorganic ion conductive substance such as sodium perchlorate, lithium perchlorate, calcium perchlorate or lithium chloride; or an organic ion conductive substance such as denatured aliphatic acid dimethyl ammonium ethosulfate, stearyl ammonium acetate, lauryl ammonium acetate.

Preferably, the electric resistance adjusting layer 2 and the gap preserving members 4 and 4 according to the present invention is provided at a cylindrical shape. Thus, continuous discharge to a same place is prevented by the rotation of the electric resistance adjusting layer 2, as a result chemical deterioration to the surface of the electric resistance adjusting layer 2 according to electric stress may be decreased.

Preferably in the present invention, the conductive member 10 is provided as a charge member to charge the image carrier 5 without contacting the surface of the image carrier 5. Thus it is possible to prevent the charge member from being contaminated and it is also possible for the charge member to be made much precisely from a hard material. Accordingly, it is possible to avoid charge fluctuation.

In the present invention, there is no shape limitation to either the conductive member 10 or the image carrier 5 in particular. The image carrier 5 may be any shape such as a belt shape, or a cylindrical shape. The conductive member 10 may be any shape such as a circular shape at cross-section (cylindrical shape), an elliptical shape at cross-section, a blade shape by flattening the cylindrical shape. It is preferable for both to have a cylindrical shape.

If the two are always kept opposing to each other at the same place, there is a chance to cause chemical deterioration to the surface of the electric resistance adjusting layer 2 according to electric stress. If the two are cylindrically shaped and rotated, it is possible to prevent continuous discharge to the same place and as a result chemical deterioration to the surfaces according to electric stress may be avoided.

As illustrated in FIG. 2, for example, a rotation direction of the conductive member 10 may be a same direction or an opposite direction to that of the image carrier 5. Moreover, it is also possible to set the conductive member 10 having a rotation speed difference to that of the image carrier 5, for example rotating faster or slower that the image carrier 5. Without undermining its functions, the image carrier 5 may be set to rotate intermittently.

It is necessary to keep the gap G between the conductive member 10 and the image carrier 5 at a predefined value, preferably not larger than 100 μm. If the value for the gap G is large than 100 μm, it is necessary to apply a higher power voltage to the conductive member 10 and as a result there arises easily electric deterioration and abnormal discharge to the image carrier 5.

Preferably in the present invention, the conductive member 10 is provided as a process cartridge 110 which is disposed close to the image carrier 5. Thus it is possible for the present invention to obtain an image with stable image quality over long term and for a use to perform easily exchange maintenance.

Preferably in the present invention, the process cartridge 110 is provided as an image formation apparatus. Thus it is possible for the present invention to obtain a high quality image with high reliability.

Figure 3:
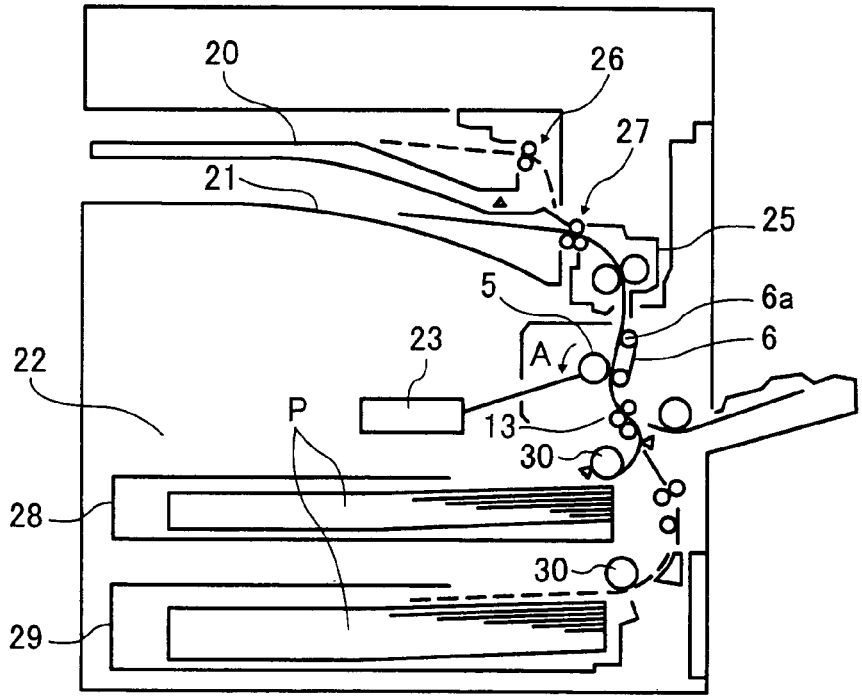
FIG. 3 is an explanatory view illustrating an embodiment of an image formation apparatus.

As illustrated in FIG. 3, the image formation apparatus according to the present invention is provided with a paper feeding section 22, an image formation section having the image carrier 5 and a paper ejecting section including a pair of paper ejecting rollers 26 and 27 in a sequence from a lower portion to an upper portion of the apparatus main body, respectively. In the image formation apparatus, a piece of transfer paper P is fed from the paper feeding section 22 to the image formation section to have an image formed thereon, then it is ejected by the paper ejecting rollers 26 and 27 through a bin tray 20 or a paper ejecting tray 21.

The paper feeding section 22 is provided stepwise with two paper trays 28 and 29, each of which is disposed with a paper feeding roller 30. A writing unit 23 projects a light uniformly onto the charged surface of the image carrier 5 and write thereon an image. An upstream side of the image carrier 5 with respect to a transfer direction of the transfer paper P is provided with a register roller pair 13 which adjusts a skew of the transfer paper P and synchronizes the image on the image carrier 5 with a transfer timing of the transfer paper P. A downstream side of the image carrier 5 with respect to the transfer direction of the transfer paper P is provided with a fixation unit 25.

The image formation section is provided with the image carrier 5 disposed rotatable along an arrow A as illustrated in FIG. 3, in the surroundings of the image carrier 5 a charge device (Refer to the numeral 102 in FIG. 4), a developing device (Refer to the numeral 104 in FIG. 4) which visualize the electrostatic latent image written by the writing unit 23 on the image carrier 5 surface charged by the charge device as a toner image, a transfer/ transport belt 6 which transfer the toner image to the transfer paper P, a cleaning device (Refer to the numeral 108 in FIG. 4) which cleans any excess toner from the image carrier 5 after the toner image is transferred, a discharge lamp (not illustrated) which removes any remaining unnecessary charge from the image carrier 5.

When the image formation apparatus is initialized, the image carrier 5 is rotated in the arrow direction A, its surface is discharged by the discharge lamp and an electric potential of which is averaged to a standard electric potential. Then the image carrier 5 surface is uniformly charged by the charge device. The charged surface is projected by the writing unit 23 with a light in correspondence to an image information to form thereon an electrostatic latent image which is transported to the developing device according to the rotation of the image carrier 5 in the arrow direction A and is adhered with toners by a developing sleeve (not illustrated) to form a toner image (visualized image).

On the other hand, the transfer paper P is fed by the paper feeding roller 30 from either of the two paper trays 28 and 29 of the paper feeding section 22, then temporarily stopped by the register roller pair 13 to adjust a precise timing that an end of the transfer paper P corresponds to an end of the image on the image carrier 5, the toner image on the image carrier 5 is transferred to the transfer paper P by the transfer/transport belt 6. After that, the transfer paper P is transported by the transfer/transport belt 6, peeled off from the transfer/transport belt 6 by a driving roller portion 6a according to a curvature of the transfer paper P and transported to the fixation unit 25 in which toners are melt and fixed according to heat or pressure on the transfer paper P which is ejected out to a determined place from either the paper ejecting tray 21 or the bin tray 20. After that any excess toner remained on the image carrier is removed by a cleaning blade of the cleaning device 108. The image formation apparatus is ready for a next image formation process.

Although the conductive member 10 is described as a charge roller in the above embodiment, without departing from the objective of the present invention it is preferable for the conductive member 10 to be a toner supporter or a transfer member.

Embodiment 1

100 weight portions of a mixture of an ABS resin (GR-0500, available from DENKI KAGAKU KOGYO KABUSHIKI KAISHA) 40 wt % and a polyether ester amide containing lithium salt (Sankonol® TBX-65, Sanko Chemical Co., Ltd.) 60 wt %, and 4.5 weight portions of polycarbonate-styrene-glycidyl methacrylate-acrylonitrile copolymer (MODIPER® CL 440-G, available from NOF Corporation) were kneaded to form a resin composition (intrinsic volume resistance value $2\times10^8$ Ωcm).

The resin composition was injected to coat on a stainless conductive supporter (core axis) of 8 mm in diameter through injection molding to form an electric resistance adjusting layer.

Ring-shaped gap preserving members made from a highly-condensed polyethylene resin (NOVATEC® HD HY540, available from Japan Polychem Corporation) were inserted respectively to both ends of the conductive supporter, contacting surfaces of the gap preserving members with respect to the electric resistance adjusting layer were coated with a primer (PR-500, available from ALTECO Inc.).

After solvents in the primer was volatized, the gap preserving members, the conductive supporter and the electric resistance adjusting layer were adhered with a cyanoacrylate adhesive (D, available from ALTECO Inc.). Through a cut processing, an outer diameter (max diameter) of each of the gap preserving members was cut to 12.12 mm and 12.00 mm for the electric resistance adjusting layer.

Then, a protection layer at a thickness of about 10 μm was formed on the electric resistance adjusting layer surface from a resin composition (intrinsic volume resistance value $2\times10^9$ Ω cm) made from an acryl silicon resin (3000 VH-P available from KAWAKAMI Paint Corporation), an isocyanate curing agent and a carbon black (35 wt % with respect to all solid ingredients). A conductive member was obtained via a calcination process.

Embodiment 2

100 weight portions of a mixture of an ABS resin (DENKA® ABS, GR-0500, available from DENKI KAGAKU KOGYO KABUSHIKI KAISHA) 40 wt % and a polyether/polyolefin block polymer containing lithium salt (Sankonole TBX-310, Sanko Chemical Co., Ltd.) 60 wt %, and 4.5 weight portions of polycarbonate-styrene-glycidyl methacylate-acrylonitrile copolymer (MODIPER® CL 440-G, available from NOF Corporation) were kneaded to form a resin composition (intrinsic volume resistance value $2\times10^8$ Ω cm).

A conductive member was obtained via further processing same as that in embodiment 1.

Embodiment 3

100 weight portions of a mixture of an ABS resin (DENKAE ABS, GR-0500, available from DENKI KAGAKU KOGYO KABUSHIKI KAISHA) 50 wt % and a polyether ester amide containing lithium salt (Sankonole TBX-65, Sanko Chemical Co., Ltd.) 50 wt %, and 4.5 weight portions of polycarbonate-styrene-glycidyl methacrylate-acrylonitrile copolymer (MODIPER® CL 440-G, available from NOF Corporation) were kneaded to form a resin composition (intrinsic volume resistance value $3\times10^8$ Ωcm).

A conductive member was obtained via further processing same as that in embodiment 1.

Embodiment 4

100 weight portions of a mixture of an ABS resin (GR-0500, available from DENKI KAGAKU KOGYO KABUSHIKI KAISHA) 60 wt % and a polyether/polyolefin block polymer containing lithium salt (Sankonol® TBX-310, Sanko Chemical Co., Ltd.) 40 wt %, and 4.5 weight portions of polycarbonate-styrene-glycidyl methacrylate-acrylonitrile copolymer (MODIPER® CL 440-G, available from NOF Corporation) were kneaded to form a resin composition (intrinsic volume resistance value $2\times10^8$ Ωcm).

The resin composition was injected to coat on a stainless conductive supporter (core axis) of 8 mm in diameter through injection molding to form an electric resistance adjusting layer.

Ring-shaped gap preserving members made from a highly-condensed polyethylene resin (NOVATEC® HD HY540, available from Japan Polychem Corporation) were inserted respectively to both ends of the conductive supporter, contacting surfaces of the gap preserving members with respect to the electric resistance adjusting layer were coated with a primer (PR-500, available from ALTECO Inc.).

After solvents in the primer was volatized, the gap preserving members, the conductive supporter and the electric resistance adjusting layer were adhered with a two-ingredient epoxy composed liquid adhesive (6100, available from ALTECO Inc.). Through a cut processing, an outer diameter (max diameter) of each of the gap preserving members was cut to 12.12 mm and 12.00 mm for the electric resistance adjusting layer.

Then, a protection layer at a thickness of about 10 μm was formed on the electric resistance adjusting layer surface from a resin composition (intrinsic volume resistance value $2\times10^9$ Ω cm) made from an acryl silicon resin (3000 VH-P available from KAWAKAMI Paint Corporation), an isocyanate curing agent and a carbon black (35 wt % with respect to all solid ingredients).

A conductive member was obtained via a calcination process.

Embodiment 5

100 weight portions of a mixture of an HI-PS resin (H450, available from TOYO STYRENE CO., LTD.) 40 wt % and a polyether ester amide containing lithium salt (Sankonol® TBX-65, Sanko Chemical Co., Ltd.) 60 wt %, and 4.5 weight portions of polycarbonate-styrene-glycidyl methacrylate-acrylonitrile copolymer (MODIPER® CL 440-G, available from NOF Corporation) were kneaded to form a resin composition (intrinsic volume resistance value $2\times10^8$ Ωcm).

A conductive member was obtained via further processing same as that in embodiment 1.

Contrast 1

100 weight portions of epichlorohydrin rubber (Epichloromer® CG from DAISO Corporation) and 3 weight portions of ammonium perchlorate were kneaded to from a rubber composition (intrinsic volume resistance value $2\times10^8$ Ωcm).

The rubber composition was injected to coat on a stainless conductive supporter (core axis) of 8 mm in diameter through injection molding to form a rubber coating layer which underwent a rubber vulcanization processing.

An electric resistance adjusting layer was formed at an outer diameter of 12 mm by grinding the vulcanized rubber coating layer.

Then, a protection layer at a thickness of about 10 μm was formed on the electric resistance adjusting layer surface from a resin composition (intrinsic volume resistance value $4\times10^{10}$ Ω cm) made from a polyvinyl butyral resin (DENKA Butyral® 3000-K available from DENKI KAGAKU KOGYO KABUSHIKI KAISHA), an isocyanate curing agent and a tin oxide (60 wt % with respect to all solid ingredients).

Next, a tape-shaped member (DAITAC® PF025-H, Dainippon Ink and Chemicals, Incorporated) with a thickness of 50 μm was adhered to two outer peripheral ends of the electric resistance adjusting layer with an one-ingredient epoxy composed liquid adhesive (2202, available from Three Bond Co., Ltd.)

A conductive member was obtained via a calcination process.

Contrast 2

A polypropylene resin (MA02, available from Japan Polychem Corporation) 50 wt % and an ion conductive high molecular compound contain quaternary ammonium (LEOREX AS-1700, available from DAI-ICHI KOGYO SEIYAKU CO., LTD.) 50 wt % were kneaded to form a resin composition.

The resin composition was injected to coat on a stainless conductive supporter (core axis) of 10 mm in diameter through injection molding to form an electric resistance adjusting layer.

Ring-shaped gap preserving members made from a polyamide resin (NOVAMID® 1010 C2, available from Mitsubishi Engineering-Plastics Corporation) were inserted respectively to both ends of the conductive supporter, the gap preserving members, the conductive supporter and the electric resistance adjusting layer were adhered with an one-ingredient epoxy composed liquid adhesive (2202, available from Three Bond Co., Ltd.). Through a cut processing, an outer diameter (max diameter) of each of the gap preserving members was cut to 12.12 mm and 12.00 mm for the electric resistance adjusting layer.

Then, a protection layer at a thickness of about 10 μm was formed on the electric resistance adjusting layer surface from a resin composition (intrinsic volume resistance value $2\times10^{10}$ Ω cm) which is made from a fluorine resin (LUMIFLON®0 LF-600, available from Asahi Glass Co., Ltd.), an isocyanate curing agent and a tin oxide (60 wt % with respect to all solid ingredients).

A conductive member was obtained via a calcination process.

Contrast 3

A polypropylene resin (MA02, available from Japan Polychem Corporation) 50 wt % and a conductive carbon black (KETJEN BLACK® EC, available from KETJEN BLACK INTERNATIONAL CO., LTD.) 50 wt % were kneaded to form a resin composition.

The resin composition was injected to coat on a stainless conductive supporter (core axis) of 10 mm in diameter through injection molding to form an electric resistance adjusting layer.

Ring-shaped gap preserving members made from a polyamide resin (NOVAMID® 1010 C2, available from Mitsubishi Engineering-Plastics Corporation) were inserted respectively to both ends of the conductive supporter, the gap preserving members, the conductive supporter and the electric resistance adjusting layer were adhered with an one-ingredient moisture curing elastic adhesive (1530, available from Three Bond Co., Ltd.). Through a cut processing, an outer diameter (max diameter) of each of the gap preserving members was cut to 12.12 mm and 12.00 mm for the electric resistance adjusting layer.

Then, a protection layer at a thickness of about 10 μm was formed on the electric resistance adjusting layer surface from a resin composition (intrinsic volume resistance value $2\times10^{10}$ Ω cm) made from a fluorine resin (LUMIFLON® LF-600, available from Asahi Glass Co., Ltd.), an isocyanate curing agent and a tin oxide (60 wt % with respect to all solid ingredients).

A conductive member was obtained via a calcination process.

Experiment 1

The conductive member obtained respectively from the above mentioned embodiments 1 to 5 and contrasts 1 to 3 was used as a charge roller, of which a circumferential resistance deviation ($\log^{\Delta R}$) was determined in evaluation conditions of a temperature at 23° C. and a relative humidity (RH) at 50% and a power voltage applied to the charge roller at 500v. The results were illustrated in Table 1.

TABLE 1

| | Circumferential Resistance Deviation ($\log^{\Delta R}$) |
|---|---|
| Embodiment 1 | 0.2 |
| Embodiment 2 | 0.2 |
| Embodiment 3 | 0.2 |
| Embodiment 4 | 0.2 |
| Embodiment 5 | 0.2 |
| Contrast 1 | 0.6 |
| Contrast 2 | 0.6 |
| Contrast 3 | 0.7 |

It is clear from Table 1 that the circumferential resistance deviation in embodiments 1 to 5 was smaller than 0.5, but larger than 0.5 in contrasts 1 to 3.

Experiment 2

Figure 4:
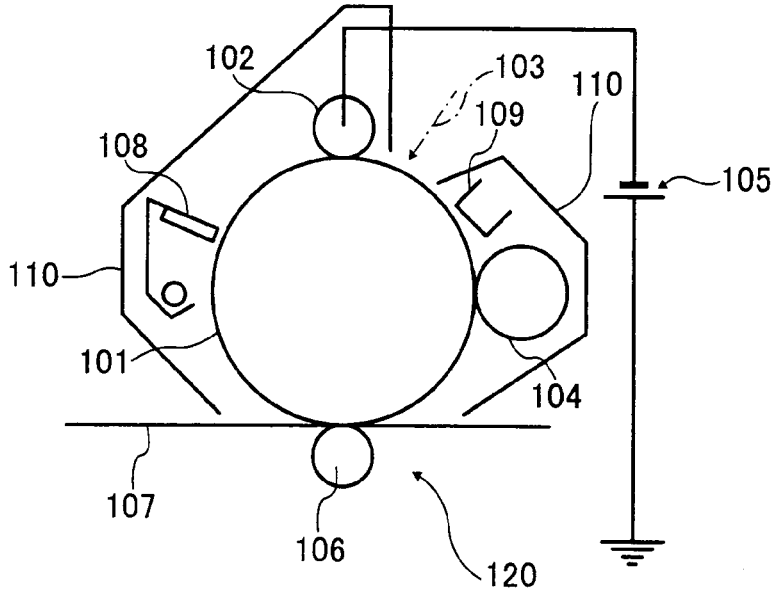
FIG.4 is a view illustrating a conventional electrophotographic image formation apparatus.

Taking the conductive member obtained respectively from the above mentioned embodiments 1 to 5 and contrasts 1 to 3 as the charge roller, an image formation apparatus as illustrated in FIG. 4 was used to determine how many copies might be performed in a 300,000-copy test before a crack occurs in evaluation conditions of a temperature at 23° C. and a relative humidity (RH) at 50% and a power voltage applied to the charge roller at DC=−800V, AC=2400 Vpp with a frequency of 2 kHz. The results were illustrated in Table 2.

TABLE 2

| | Copies Until Crack Occurred | Evaluation |
|---|---|---|
| Embodiment 1 | >300,000 | OK |
| Embodiment 2 | >300,000 | OK |
| Embodiment 3 | >300,000 | OK |
| Embodiment 4 | >300,000 | OK |
| Embodiment 5 | >300,000 | OK |
| Contrast 1 | = 90,000 | NG |
| Contrast 2 | =120,000 | NG |
| Contrast 3 | = 30,000 | NG |

It is clear from Table 2 that a crack didn't occur in the 300,000-copy test in embodiments 1 to 5 but occurred in the 300,000-copy test in contrasts 1 to 3.

Experiment 3

Taking the conductive member obtained respectively from the above mentioned embodiments 1 to 5 and contrasts 1 to 3 as the charge roller, an image formation apparatus as illustrated in FIG. 4 was used to determine a charge potential of the image carrier, a charge potential fluctuation, a partial improper charge and an improper image according to an abnormal discharge (a leak) to a defect portion on the image carrier in evaluation conditions of a temperature at 23° C. and a relative humidity (RH) at 50% and a power voltage applied to the charge roller at DC=−800V, AC=2400 Vpp with a frequency of 2 kHz.

Thereafter, whether there is or not a toner adhesion on the roller surface or a partial improper charge was also determined after a 100,000-copy test in evaluation conditions of a temperature at 23° C. and a relative humidity (RH) at 50%.

The results were illustrated in Table 3.

TABLE 3

| | Receptor Charge Potential | charge potential fluctuation | partial improper charge | Abnormal discharge | toner adhesion after copy | partial improper charge after copy |
|---|---|---|---|---|---|---|
| Embodiment 1 | −780 V | 10 V | NG | NG | NG | NG |
| Embodiment 2 | −780 V | 10 V | NG | NG | NG | NG |
| Embodiment 3 | −780 V | 10 V | NG | NG | NG | NG |
| Embodiment 4 | −780 V | 10 V | NG | NG | NG | NG |
| Embodiment 5 | −780 V | 10 V | NG | NG | NG | NG |
| Contrast 1 | −300 V | 40 V | YES | YES | YES | YES |
| Contrast 2 | −360 V | 50 V | YES | YES | YES | YES |
| Contrast 3 | −280 V | 20 V | YES | YES | YES | YES |

It is clear from Table 3 that all good results were obtained for the charge roller in embodiments 1 to 5 and problems were seen in contrasts 1 to 3.

Experiment 4

Similar to the experiment 3, taking the conductive member obtained respectively from the above mentioned embodiments 1 to 5 and contrasts 1 to 3 as the charge roller, an image formation apparatus as illustrated in FIG. 4 was used to determine a relationship between a charge potential of the image carrier and a partial improper charge, and an improper image according to an abnormal discharge (a leak) to a defect portion on the image carrier in evaluation conditions of a temperature at 10° C. and a relative humidity (RH) at 15%, and a temperature at 30° C. and a relative humidity (RH) at 90%, respectively, results of which were illustrated in Table 4 and Table 5, respectively.

TABLE 4

| | Receptor Charge Potential | partial improper charge | Abnormal discharge |
|---|---|---|---|
| Embodiment 1 | −780 V | NG | NG |
| Embodiment 2 | −780 V | NG | NG |

TABLE 4-continued

| | Receptor Charge Potential | partial improper charge | Abnormal discharge |
|---|---|---|---|
| Embodiment 3 | −780 V | NG | NG |
| Embodiment 4 | −780 V | NG | NG |
| Embodiment 5 | −780 V | NG | NG |
| Contrast 1 | −180 V | YES | YES |
| Contrast 2 | −200 V | YES | YES |
| Contrast 3 | −160 V | YES | YES |

TABLE 5

| | Receptor Charge Potential | partial improper charge | Abnormal discharge |
|---|---|---|---|
| Embodiment 1 | −790 V | NG | NG |
| Embodiment 2 | −790 V | NG | NG |
| Embodiment 3 | −790 V | NG | NG |
| Embodiment 4 | −790 V | NG | NG |
| Embodiment 5 | −300 V | NG | NG |
| Contrast 1 | −490 V | YES | YES |
| Contrast 2 | −500 V | YES | YES |
| Contrast 3 | −370 V | YES | YES |

It is clear from Tables 4 and 5 that all good results were obtained for the charge roller in embodiments 1 to 5 and problems were seen either at a low temperature and humidity or at a high temperature and humidity in contrasts 1 to 3.

Although the present invention has been explained in relation to its preferred embodiment and drawings but not limited, it is to be understood that other possible modifications and variations made without departing from the spirit and scope of the invention will be comprised in the present invention. Therefore, the appended claims encompass all such changes and modifications as falling within the true spirit and scope of this invention.

What is claimed is:

1. A conductive member comprising:

a conductive supporter;

an electric resistance adjusting layer formed on the conductive supporter; and gap preserving members which are of a different material from that of the electric resistance adjusting layer and are disposed respectively at both ends of the electric resistance adjusting layer for contacting an image carrier so as to preserve a predefined gap between the electric resistance adjusting layer and the image carrier, wherein the electric resistance adjusting layer is made from a resin composition which is prepared by melting and kneading a thermoplastic resin;

a high molecular ion conductive material containing an alkali metal salt, wherein the high molecular ion conductive material is made from a compound at least having an ether group selected from a compound containing a polyether ester amide and a polyether-polyolefin block polymer; and a graft copolymer which has an affinity for both the thermoplastic resin and the high molecular ion conductive material.

2. The conductive member set forth in claim 1, wherein the alkali metal salt is a lithium salt.

3. The conductive member set forth in claim 1, wherein the graft copolymer includes a polycarbonate in a main chain and an acrylonitrile-styrene-glycidyl methacrylate terpolymer in a side chain.

4. The conductive member set forth in claim 1, wherein the gap preserving member is adhesively fixed on at least one sort of the conductive supporter and the electric resistance adjusting layer.

5. The conductive member set forth in claim 1, wherein the gap preserving member is adhesively fixed on at least one sort of the conductive supporter and the electric resistance adjusting layer via a primer applied to the gap preserving member.

6. The conductive member set forth in claim 1, wherein the electric resistance adjusting layer includes a protection layer which prevents a toner from attaching to an outer surface of the electric resistance adjusting layer.

7. The conductive member set forth in claim 1, wherein the electric resistance adjusting layer and the gap preserving member are provided with a cylinder shape.

8. The conductive member set forth in claim 1, wherein the conductive member is a charge member.

9. A process cartridge comprising the charge member set forth in claim 8 which is disposed close to a member to be charged.

10. An image formation apparatus comprising the process cartridge set forth in claim 9.

11. A conductive member comprising:

a conductive supporter;

an electric resistance adjusting layer formed on the conductive supporter; and gap preserving members which are of a different material from that of the electric resistance adjusting layer and are disposed respectively at both ends of the electric resistance adjusting layer for contacting an image carrier so as to preserve a predefined gap between the electric resistance adjusting layer and the image carrier, wherein the electric resistance adjusting layer is made from a resin composition which is prepared by melting and kneading a thermoplastic resin;

a high molecular ion conductive material containing an alkali metal salt; and a graft copolymer which has an affinity for both the thermoplastic resin and the high molecular ion conductive material, wherein the graft copolymer comprises a polycarbonate in a main chain and an acrylonitrile-styrene-glycidyl methacrylate terpolymer in a side chain.

12. The conductive member set forth in claim 11, wherein the alkali metal salt is a lithium salt.

13. The conductive member set forth in claim 11, wherein the high molecular ion conductive material is made from a compound at least having an ether group.

14. The conductive member set forth in claim 11, wherein the gap preserving member is adhesively fixed on at least one sort of the conductive supporter and the electric resistance adjusting layer.

15. The conductive member set forth in claim 11, wherein the gap preserving member is adhesively fixed on at least one sort of the conductive supporter and the electric resistance adjusting layer via a primer applied to the gap preserving member.

16. The conductive member set forth in claim 11, wherein the electric resistance adjusting layer includes a protection layer which prevents a toner from attaching to an outer surface of the electric resistance adjusting layer.

17. The conductive member set forth in claim 11, wherein the electric resistance adjusting layer and the gap preserving member are provided with a cylinder shape.

18. The conductive member set forth in claim 11, wherein the conductive member is a charge member.

19. A process cartridge comprising the charge member set forth in claim 18 which is disposed close to a member to be charged.

20. An image formation apparatus comprising the process cartridge set forth in claim 19.

* * * * *